US006038747A

United States Patent [19]

Hamilton et al.

[11] Patent Number: 6,038,747

[45] Date of Patent: Mar. 21, 2000

[54] PACK WAIST-BELT AND BUCKLES THEREFOR

[75] Inventors: Jeffrey R. Hamilton, Hoffman Estates; John S. Pontaoe, Chicago, both of Ill.; Bryce Thatcher, Rexburg, Id.

[73] Assignee: Illinois Tool Works Inc., Glenview, Ill.

[21] Appl. No.: 09/243,561

[22] Filed: Feb. 3, 1999

[51] Int. Cl.[7] ..... A44B 11/00; A45F 5/00; B68B 5/00

[52] U.S. Cl. ..... 24/164; 24/171; 24/197; 24/182; 24/632; 224/257

[58] Field of Search ..... 24/164, 171, 172, 24/197, 182, 185, 632, 265 CD, 265 BC, 308, 573.5, 634; 224/257, 258

[56] References Cited

U.S. PATENT DOCUMENTS

| | | | |
|---|---|---|---|
| 268,089 | 11/1882 | Freer | 24/164 |
| 268,778 | 12/1882 | Bostwick | 24/185 |
| 327,622 | 10/1885 | Tourgee et al. | 24/171 |
| 381,123 | 4/1888 | Frost | 24/182 |
| 518,125 | 10/1894 | Smith | 24/185 |
| 660,544 | 10/1900 | Gelabert | 24/182 |
| 987,326 | 3/1911 | Savage | 24/164 |
| 1,548,023 | 8/1925 | Cowell | 24/634 |
| 2,809,408 | 10/1957 | Goldstein | 24/197 |
| 2,986,362 | 5/1961 | Gimalouski | 24/632 |
| 4,150,464 | 4/1979 | Tracy . | |
| 4,171,555 | 10/1979 | Bakker et al. . | |
| 4,398,324 | 8/1983 | Bakker et al. . | |
| 4,848,794 | 7/1989 | Mader et al. | 24/171 |
| 5,088,163 | 2/1992 | Van Riesen | 24/632 |
| 5,307,967 | 5/1994 | Seals | 224/257 |

OTHER PUBLICATIONS

ITW Nexus, "The Cutting Edge" product brochure, pp. 1–23.

*Primary Examiner*—Victor N. Sakran

[57] ABSTRACT

A waist-belt and buckle assembly for mounting a pack on a person, preferably on a back side portion of a human torso, having two strap portions extendable forwardly from each side portion of the pack toward a front side portion of the person where the four strap portions are fastenable, for example with a buckle, and preferably with a buckle having substantially discrete accommodations for each strap portion. The strap portions are independently adjustable, and are loosenable independently without loosening other strap portions, preferably by moving a corner portion of the buckle away from the torso.

25 Claims, 3 Drawing Sheets

PACK WAIST-BELT AND BUCKLES THEREFOR

BACKGROUND OF THE INVENTION

The invention relates generally to personal pack harnesses, and more particularly to adjustable waist-belt and buckle assemblies useable for holding a load carrying pack on a person, and combinations thereof.

It is known generally to support or hold load carrying packs, for example waist and fanny packs, knapsacks, and backpacks, on a posterior or back side portion of a human torso with a waist-belt. In some applications, waist-belts are used in combination with shoulder belts, for example on knapsacks and backpacks.

Known pack waist-belts include generally strap portions extending forwardly from opposing side portions of the pack toward an anterior, or frontal, portion of the torso where the two strap portions are fastened, for example with a unitary buckle, or with a buckle having releasably mating male and female members. Known buckles suitable for this purpose include, among others, non-separable unitary buckles disclosed in U.S. Pat. No. 4,171,555 entitled "Buckle", side release buckles disclosed in U.S. Pat. No. 4,150,464 also entitled "Buckle", and center release buckles disclosed in U.S. Pat. No. 4,398,324 entitled "Center Release Buckle", all of which are assigned commonly herewith and incorporated by reference herein.

The inventors of the present invention recognize that it is generally desirable to adjust the mounting or location of the pack on the torso, for example by adjustably mounting the pack preferably on a back side portion of the torso, to compensate for variations in body shape so that the pack may be carried more effectively and more comfortably. It is also desirable to adjust the mounting of the pack to compensate for variations in the shape and weight distribution of the pack, which tends to change depending on the particular load therein. The ability to shift the mounting of the pack from one portion of the torso to another is also desirable to reduce localized body fatigue, which tends to occur after prolonged mounting.

It is known generally to adjustably secure one or both strap portions of prior art waist-belts to a buckle to permit tightening and loosening of the waist-belt about the waist portion of the torso. The mere tightening and loosening of waist-belt tension in prior art waist-belts however provides a very limited, if any, degree of pack mounting adjustability and generally does not compensate for variations in body shape and for variations in shape and weight distribution of the pack.

Known pack waist-belts also have a tendency to uncomfortably bind, or pinch, soft tissue of the torso between the waist-belt and upper portions of the hip bones, or pelvis, especially outwardly flaring rim portions thereof on opposing side portions of the torso. It is known to provide wings or flaps extending forwardly from the pack along opposing side portions of the torso to protect the hip bones. The known flaps include relatively rigid plastic members and contoured fabric members. These flaps however are relatively costly. These flaps also provide no pack mounting adjustability, and in fact some flaps, for example the more rigid flaps, may actually prevent or obstruct pack mounting adjustment. Additionally, some flaps, particularly plastic flaps, tend to interfere with the evaporation of perspiration, which is uncomfortable, and some flaps may substantially increase weight of the waist-belt.

It is also known generally to provide one or more adjustment straps extending forwardly at least partially from each side of the pack. The DELTA-BELT available from Mountain Smith Company, Golden Colo., for example, includes an angled strap portion adjustably coupled between the pack and a portion of the waist-belt on a side portion of the torso, adjacent to or rearwardly of the upper hip bone portions. The angled strap on the DELTA-BELT however provides a very limited range of adjustability resulting from its relatively short length and the location of its coupling to the waist-belt on the side portion of the torso. Thus the DELTA-BELT does not adequately compensate for variations in body shape and for variations in pack shape and load distribution. Additionally, the DELTA-BELT can not be adjusted to avoid or at least substantially reduce discomfort caused by pinching of soft tissue against the pelvis. Moreover, the angled strap portion of the DELTA-BELT is very difficult, if not impossible, to adjust when the pack is mounted, and in practice requires removal of the waist-belt to adjust in a trial and error process, which is inconvenient. Other known pack waist belts include two generally parallel adjustable strap portions extending forwardly a relatively short distance from each side of the pack. These adjustable straps however are also coupled to the waist-belt on a side portion of the torso, adjacent to or rearwardly of the pelvis, and suffer from the same limitations on adjustability and access as discussed above in connection with other prior art pack waist-belts.

The invention is drawn toward advancements in the art of personal pack harnesses and buckles therefor, useable for holding a pack on an animal and preferably on a person, and combinations thereof.

An object of the invention is to provide a novel waist-belt and buckle assembly, and more generally a torso harness, useable for adjustably holding a pack on a person and combinations thereof that overcome problems in the art.

Another object of the invention is to provide a novel adjustable waist-belt and buckle assembly useable for holding a pack on a person that is economical.

A further object of the invention is to provide a novel waist-belt and buckle assembly useable for adjustably holding a pack on a living torso, preferably adjustably mounting the pack on a back side portion of a human torso, to compensate for variations in body shape, or to compensate for variations in the shape and weight distribution of the pack, or to adjust the mounting of the pack from one portion of the torso to another, or to prevent the pinching of soft tissue between the waist-belt and bony structure, for example the pelvis, especially on side portions of the torso.

A further object of the invention is to provide a novel waist-belt and buckle assembly, or harness, whereby the waistbelt and buckle assembly is readily adjustable when the pack is mounted, and preferably adjustable from a front side portion of the person or at least forwardly of upper portions of the hip bones.

A more particular object of the invention is to provide a novel waist-belt and buckle assembly useable for mounting a pack on a person, preferably on a back side portion of a human torso, having two strap portions extendable forwardly from each side portion of the pack toward a front side portion of the person where the four strap portions are fastenable, for example with a buckle, and preferably with a buckle having discrete accommodations for each strap portion.

Another object of the invention is to provide a novel waist-belt and buckle assembly useable for mounting a pack on a person having strap portions that are independently adjustable, and strap portions that are loosenable independently, preferably by moving a portion of the buckle away from the torso, without loosening other strap portions.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
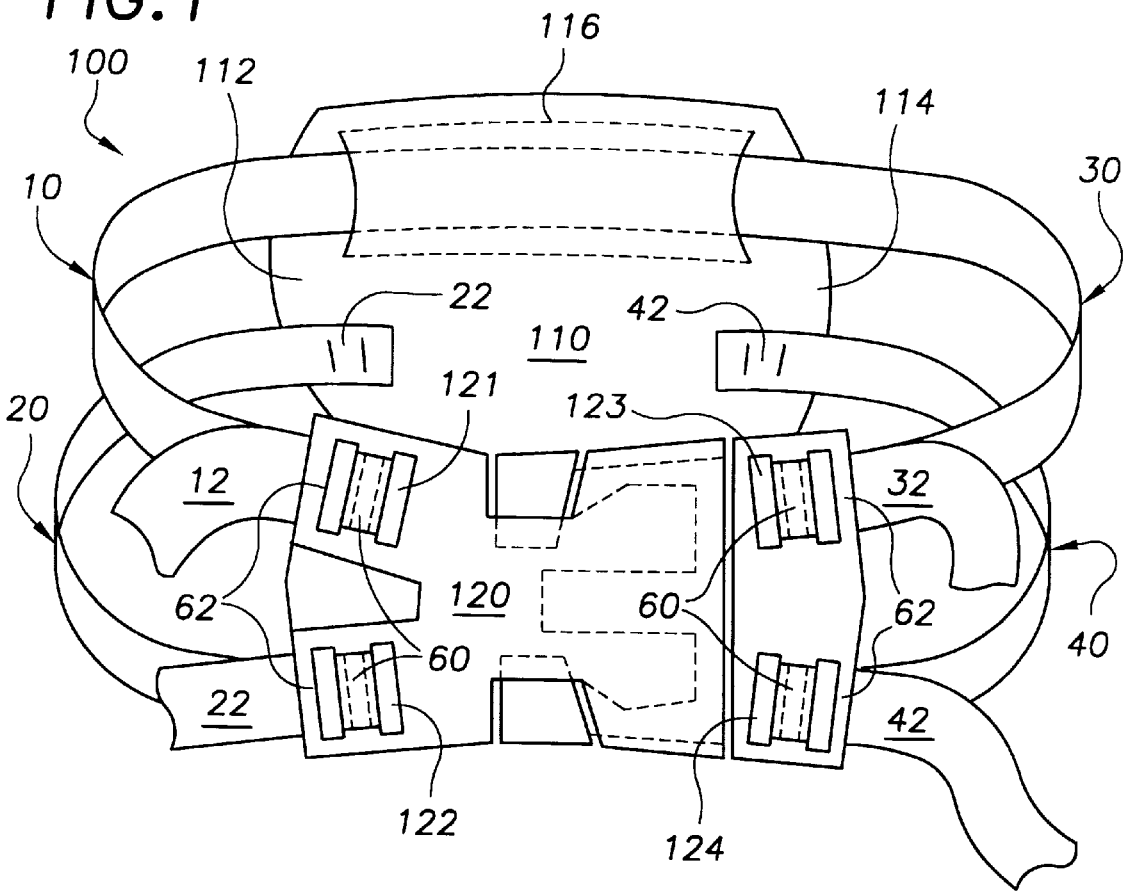
FIG. 1 is an apparatus, or harness, useable for holding a pack on a person according to at exemplary embodiment of the invention.

FIG. 1 is an apparatus 100, useable for holding a pack 110 on a person, comprising generally a buckle 120 coupled, preferably adjustably, to fastening strap portions of a waist-belt disposable about an animal or human torso, and preferably about a waist portion of a human torso.

The exemplary pack 110 is a waist or fanny pack. The pack 110 may more generally be a knapsack or a backpack or any other type of body pack, or a tool or utility belt, or a back support device, which is mountable on a human or animal torso, and preferably on a back side portion of a human torso as discussed more fully below. Thus the term "pack" as used in the present specification including the claims thereof is to be interpreted as including any one or more of the embodiments defined hereinabove.

FIG. 1 illustrates first and second strap portions 10 and 20 coupled to and extending from, or coupleable to and extendable from, a first side portion 112 of the pack 110, and third and fourth strap portions 30 and 40 coupled to and extending from, or coupleable to and extendable from, a second generally opposing side portion 114 of the pack 110. The strap portions may be coupled to the pack by any means.

FIG. 1 illustrates one embodiment wherein the first and third strap portions 10 and 30 compose, or constitute, a continuous strap member that is coupled to the pack 110 by slidably inserting the strap member through a channel 116, illustrated in phantom, of the pack 110. The second and fourth strap portions 20 and 40 also may be coupled to the pack 110 through a corresponding channel, not shown, in a manner similar to the first and third strap portions. Alternatively, the first and fourth strap portions may constitute a continuous strap member and the second and third strap portions may constitute a continuous strap member, each of which is disposed through corresponding channels in a crossed pattern.

FIG. 1 illustrates another embodiment wherein the second and fourth strap portions 20 and 40 are coupled to the pack 110 by fastening end portions 22 and 42 thereof to the pack, for example with stitches or rivets or other known fastening means. The first and third strap portions 10 and 30 also may be coupled to the pack 110 in a manner similar to the second and fourth strap portions.

Figure 3:
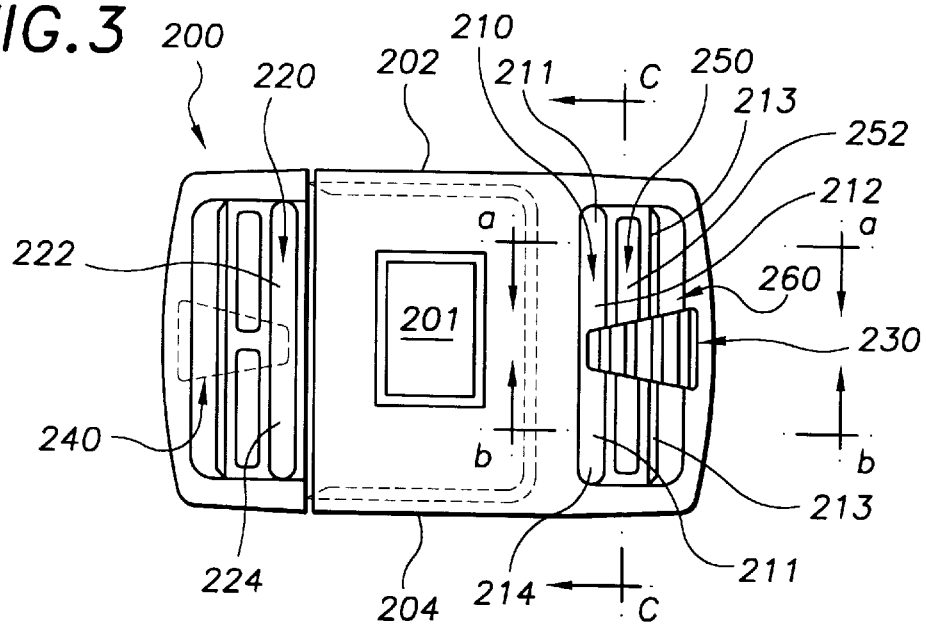
FIG. 3 is a top plan view of an alternative buckle.

The buckle 120 generally fastens at least two and preferably four strap portions extending from the pack and disposed about the torso, and preferably the strap portions are coupled adjustably to the buckle 120, as discussed further below. In a preferred embodiment, the buckle comprises a first, or female, buckle member having a recess portion, and a second, or male, buckle member having a tongue portion engageably and releasably disposable in the recess portion of the female buckle member. FIG. 1 illustrates a side release buckle having male and female buckle members that are releasably engageable as is known generally and disclosed more fully in U.S. Pat. No. 4,150,464 entitled "Buckle", and FIG. 3 illustrates a center release buckle having male and female buckle members that are releasably engageable as is known generally and disclosed more fully in U.S. Pat. No. 4,398,324 entitled "Center Release Buckle". Other suitable buckles include non-separable unitary buckles of the generally known type disclosed more fully in U.S. Pat. No. 4,171,555 entitled "Buckle".

The prior art buckles incorporated herein by reference are modified substantially according to the preferred embodiments of the present invention, particularly the portions of the buckles to which the straps portions are coupled, as discussed more fully below. The releasably engageable buckle members of the buckles of the present invention discussed above and further below are each preferably unitary members formed of a plastic in a molding operation, or of a metal in a stamping or casting operation, or of some other material known in the art.

Figure 2:
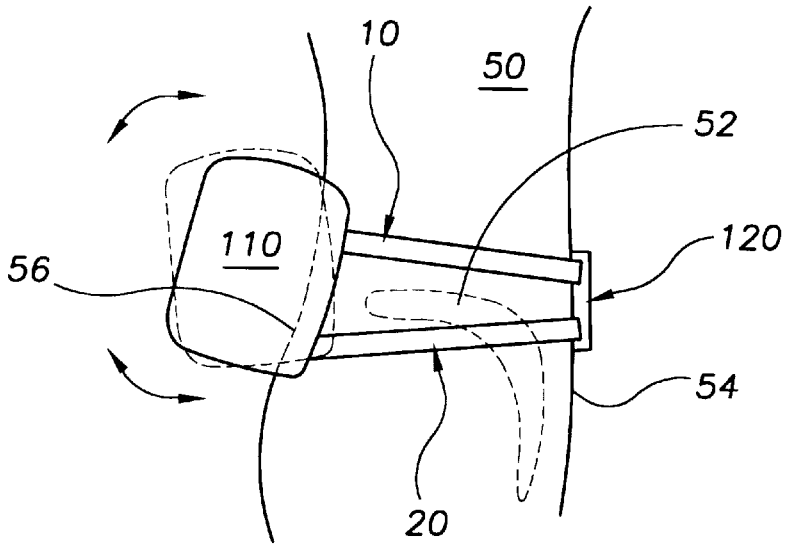
FIG. 2 is a partial side view of an exemplary waist-belt and buckle assembly, or harness, adjustably mounting a pack on a person.

FIG. 2 illustrates the adjustable first and second strap portions 10 and 20 extendable forwardly from the pack 110 and about a first side portion of the person, and more particularly about the waist portion of the torso 50. The adjustable third and fourth strap portions are similarly extendable forwardly from the pack 110 and about a second generally opposing side portion of the person, not shown but substantially the same as the side portion illustrated in FIG. 2. When the buckle 120 is located on the front side portion 54 of the person, or torso, to adjustably mount the pack 110 on a back side portion 56 thereof, the couplings between the first and second strap portions 10 and 20 and the buckle are located preferably forwardly of a first upper pelvis portion 52 on the first side portion of the person and the couplings between the third and fourth strap portions 30 and 40 and the buckle are also located preferably forwardly of a second upper pelvis portion on the second side portion of the person, which is substantially the same as that illustrated in FIG. 2.

FIG. 2 illustrates the pack 110 adjustably mountable on the back side portion 56 of the torso 50 by adjusting, and more particularly by appropriately shortening and lengthening the relatively long strap portions 10–40 extending forwardly from the pack 110. As discussed above, the strap portions 10–40 preferably extend at least forwardly of the upper pelvis portions 52 to increase the range of pack mounting adjustability to compensate for variations in body shape, and to compensate for variations in the shape and weight distribution of the pack, and to adjust the mounting of the pack from one portion of the torso to another, and also to prevent or at least substantially reduce pinching of soft tissue against the pelvis as discussed further below. In the exemplary embodiment of FIG. 2, the strap portions 10–40 extend to the front side portion 54 of the torso 50 where they are coupled directly to the buckle 120, which still further increases the range of pack mounting adjustability.

Coupling the adjustable strap portions 10–40 to the buckle 120 forwardly of the upper pelvis portion 52 provides a relatively increased range of pack mounting adjustability on the torso than is possible with known prior art waist-belts.

The increased range of pack mounting adjustability in the present invention is due generally to the provision of two relatively long adjustable strap portions extending forwardly from each side portion of the pack 110 on opposing side portions of the torso 50, preferably forwardly of the upper pelvis portions 52 as discussed. The relatively long strap portions 10–40 permit adjusting the mounting of the pack on the torso, wherein the buckle 120 remains substantially at the same location of the front side portion 54 thereof. In FIG. 2, for example, the strap portions may be loosened to move the buckle 120 on the back side portion of the torso. The pack mounting orientation at a particular location about the torso may be adjusted over a relatively wide range to permit more tightly, or snugly, mounting of the pack on the torso to selectively or to more uniformly distribute the pack load.

Providing two strap portions extending forwardly from the pack 110 on each side of the torso 50 at least forwardly of the upper pelvis portion 52 also permits location of the strap portions about the torso 50 where soft tissue will not be pinched between the strap portions and the upper pelvis portions 52. In FIG. 2, the first strap portion 10 is positioned above the upper pelvis portion 52 and the second strap portion 20 is positioned below the upper pelvis portion 52 thereby eliminating or at least reducing the pinching of soft tissue between the waist-belt and the upper pelvis portions, especially the outwardly flaring rim portions thereof on opposing side portions of the torso, which tend to pinch the soft tissue with prior art waist-belts.

Coupling the strap portions 10–40 directly to the buckle 120 on the front side portion 54 of the torso 50, as illustrated in FIGS. 1 and 2, rather than just forwardly of the upper pelvis portions 52 helps ensure that the strap portions will not pinch soft tissue in a relatively wide range of users, since the precise location on the torso 50 where the upper pelvis portions 52 thereof begin to recede and extend downwardly toward the corresponding hip sockets where interference with the strap portions no longer occurs varies considerably among individuals.

The increased range of pack mounting adjustability on the torso now possible with the novel waist-belt and buckle assemblies of the present invention is highly desirable and is a remarkable improvement over the prior art. The increased range of pack mounting adjustability accommodates greater variations in human body shape, compensates for greater variations in the shape and weight distribution of the pack, provides the ability to shift or adjust the mounting of the pack from one portion of the torso to another to eliminate or at least substantially reduce localize fatigue, and eliminates or at least substantially reduces the pinching of soft tissue between the waist-belt and portions of the pelvis, especially on side portions of the torso.

FIG. 1 illustrates the first, second, third and fourth strap portions 10–40 having corresponding first end portions 12, 22, 32 and 42 coupled generally to corresponding first, second, third and fourth portions of the buckle 120. In the exemplary embodiment, the first, second, third and fourth strap portions are adjustably coupled directly to the buckle. Although in other embodiments, the strap portion adjustment may be separated from the coupling of the strap portions to the buckle.

The buckle 120 comprises a first substantially discrete opening 121 through the first portion thereof into which the first strap portion 10 is disposed, a second substantially discrete opening 122 through the second portion thereof into which the second strap portion 20 is disposed, a third substantially discrete opening 123 through the third portion thereof into which the third strap portion 30 is disposed, and a fourth substantially discrete opening 124 through the fourth portion thereof into which the fourth strap portion 40 is disposed. In one preferred embodiment, the first, second, third and fourth substantially discrete openings 121–124 are substantially discrete slots located on corresponding portions of the buckle.

The first and second substantially discrete openings 121 and 122 are arranged generally end to end on a first end portion of the buckle 120, and the first and second substantially discrete openings are preferably arranged at an angle so that the first and second strap portions 10 and 20 extend divergently from the buckle where the strap portions are coupled thereto. Similarly, the third and fourth substantially discrete openings 123 and 124 are arranged generally end to end on a second end portion of the buckle, and the third and fourth substantially discrete openings are arranged preferably at an angle so that the third and fourth strap portions extend divergently from the buckle where the strap portions are coupled thereto. In one embodiment, the angle between the diverging strap portions is approximately 25 degrees. This exemplary angle however is not intended to be limiting, and more generally may be more or less depending on the particular application requirements.

In FIG. 1, the buckle 120 comprises generally first and second releasably engageable buckle members. The first end portions 12 and 22 of the first and second strap portions 10 and 20 are coupled to a first end portion of the first buckle member generally opposing the recess portion thereof, and the first end portions 32 and 42 of the third and fourth strap portions 30 and 40 are coupled to a second portion of the second buckle member generally opposing the tongue portion thereof, whereby the first and second strap portions 10 and 20 and the third and fourth strap portions 30 and 40 are coupled to generally opposing end portions of the buckle 120, as illustrated.

In FIG. 1, each of the first, second, third and fourth substantially discrete openings 121–124 include corresponding first and second bars 60 and 62 for adjustably coupling the corresponding first, second, third and fourth strap end portions 10–40 thereto. More particularly, each strap portion is disposed about the corresponding first bar 60 so that corresponding overlapping portions of the strap portion are frictionally engageable adjacent the second bar 62 to adjustably couple the corresponding strap portion to the buckle.

The arrangement of first and second bars to adjustably couple a strap portion is known generally and disclosed more fully in U.S. Pat. No. 4,171,555 entitled "Buckle". The arrangement of first and second bars to adjustably couple a strap portion is also known commercially as a LADDERLOC, and is incorporated in buckles and other web fastening and adjustment devices available from ITW Nexus, Des Plaines, Ill. The various buckle and LADDERLOC combinations disclosed herein according to the present invention however are patentably distinguished over the known prior art LADDERLOC devices of the prior art.

An alternative to adjustably coupling the strap portions 10–40 directly to a buckle formed integrally with corresponding LADDERLOCs, is to couple the strap portions to corresponding openings through the buckle 120, and to include a LADDERLOC strap adjustment device located somewhere along the corresponding strap portion between the pack 110 and the buckle 120, preferably closer to the buckle so that strap adjustments may be made conveniently without removal of the pack from the person when the buckle is located on the front side portion of the torso. LADDERLOC strap adjustment devices suitable for this alternative embodiment are also available from ITW Nexus, Des Plaines, Ill.

FIG. 3 illustrates an alternative buckle 200 useable for fastening strap portions 10–40 extending from side portions of the pack 110 illustrated in FIG. 1. The buckle 200 comprises generally a body member 201, and in the exemplary embodiment the body member 201 is that of a center release type buckle having a first buckle member with a recess portion, and a second buckle member with a tongue portion engageably and releasably disposable in the recess portion of the first buckle member, as is known generally and discussed above.

The buckle 200 of FIG. 3 also comprises a first opening 210 on a first portion of the body member 201 for receiving a first strap end portion, and a second opening 220 on a second portion of the body member 201 for receiving a second strap end portion. Unitary and releasably engageable buckles having these features are known generally, and are available commercially from ITW Nexus, Des Plaines, Ill. The buckle 200 of FIG. 3 having the additional features discussed further below may in the alternative be a side release buckle or a non-separable unitary buckle, discussed generally above.

According to the present invention, the buckle 200 also comprises a discrete first divider member 230 disposed and retained at least partially in the first opening 210 of the body member to at least partially divide the first opening 210 into two opening portions 212 and 214 arranged generally end to end between opposing side portions 202 and 204 of the body member 201, whereby the two opening portions 212 and 214 of the body member accommodate corresponding strap end portions arranged generally side by side and separated by the first divider member 230, for example the third and fourth strap portions 30 and 40 illustrated in FIG. 1.

In pack mounting applications of the type discussed above in connection with FIG. 1, the alternative buckle 200 in FIG. 2 also comprises a discrete second divider member 240, illustrated in phantom, disposed at least partially in the second slot 220 to at least partially divide the second slot into two slots 222 and 224 arranged generally end to end between opposing side portions 202 and 204 of the body portion 201, whereby the two slots accommodate corresponding strap portions arranged generally side by side and separated by the second divider member 240, for example the first and second strap portions 10 and 20 illustrated in FIG. 1.

The discrete divider members 230 and 240 function generally to separate and to prevent overlapping of adjacent strap portions disposed into or through adjacent openings 212 and 214 and adjacent openings 222 and 224 formed thereby. It is not necessary for the divider members to completely separate the corresponding openings into two strictly separate, or discrete, opening portions as illustrated in the exemplary embodiment of FIG. 1, so long as the divider members separate and prevent overlapping of adjacent strap portions. In other words, there may be a gap between adjacent openings 212 and 214 and between adjacent openings 222 and 224 so long as the gap is small enough to prevent lateral movement of a strap portion from one opening to the other adjacent opening, for example from opening 212 to opening 214. Thus according to the present invention, a "substantially discrete opening" is an opening that separates and prevents overlapping of adjacent strap portions.

The first opening 210 of the body member 201 is preferably a first slot therethrough extending between side portions 202 and 204 of the body member 201, and a first bar 250 is preferably disposed in the first slot 210 to form first parallel slot portions 211 and 213 between the side portions 202 and 204. Thus prior to assembly of the first discrete divider member 230, the first bar 250 divides the opening portion 212 into parallel portions 211 and 213, and the first bar 250 similarly divides the opening portion 214 into parallel portions 211 and 213. A second bar disposed in the second opening 220 provides similar structure on the other end of the body member.

The first opening, or slot, 210 also has associated therewith a second bar 260 arranged generally parallel to the first bar 250 to provide a LADDERLOC configuration. Assembly of the first discrete divider member 230 provides adjacent substantially discrete LADDERLOCs, whereby adjacent strap portions are disposable about the first bar 250 so that overlapping portions thereof are frictionally engageable adjacent the second bar 260 to adjustably couple the adjacent strap portions to a common side of the buckle as discussed above. Assembly of the second discrete divider member 240 provides a similar arrangement of adjacent substantially discrete LADDERLOCs on the other side of the body member.

Figure 4A:
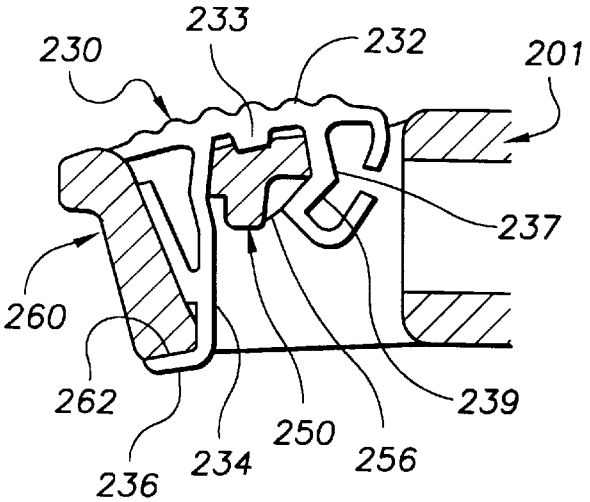
FIG. 4*a* is a partial sectional view along lines a—a of FIG. 3.
Figure 4B:
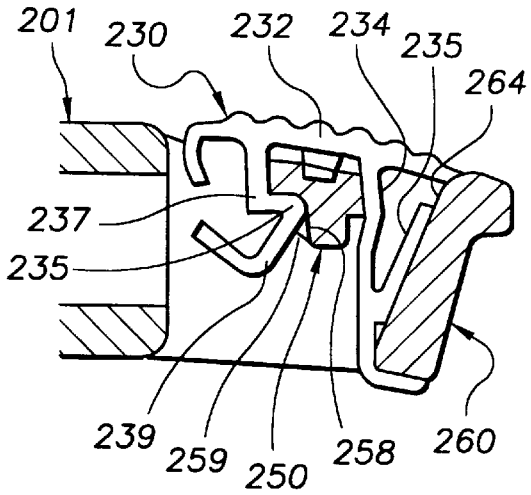
FIG. 4*b* is a partial sectional view along lines b—b of FIG. 3.

The divider member is generally disposed over the corresponding first bar and generally fastened to the body member. FIGS. 4*a* and 4*b* illustrate the first divider member 230 having a first cover portion 232 disposed over the first bar 250, and a first arm portion 234 extending therefrom between the first bar 250 and the second bar 260. In FIG. 4*a*, the first arm 234 includes a first flange portion 236 engageable with the second bar 260, and more particularly a lower portion 262 thereof to fasten the first divider member 230 to the body member 201.

The first arm portion 234 and the first flange portion 236 of the first divider member 230 are resilient so that when the first arm portion 234 is disposed between the first and second bars 250 and 260, the first arm portion is flexible away from the second bar 260 to permit passage of the first flange portion 236 beyond the lower portion 262 thereof, whereupon the first arm portion 234 is flexible back toward the second bar so that the first flange portion 236 engages the second bar 260.

FIG. 4*b* illustrates the first divider member 230 including preferably an alternative first spring member 235 extending from the first arm portion 234 and biased into engagement with a side portion 264 of the second bar 260 when the divider member is fastened to the buckle. The first spring member 235 is flexed when the divider member is fastened to the body member 201, and more particularly when the flange portion 236 is engaged with the end portion 262 of the second bar 260 to more firmly fasten the divider member 230 to the buckle, thereby preventing any rattling of the divider member 230 against the body member 201 and noise generated thereby.

Figure 4C:
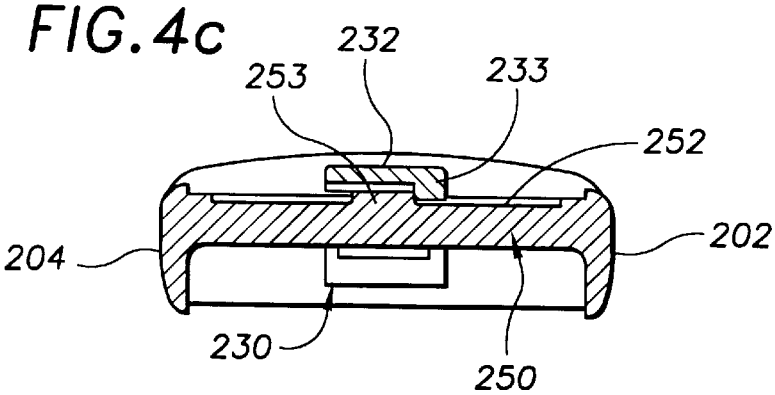
FIG. 4*c* is a partial sectional view along lines c—c of FIG. 3.

The divider member preferably includes a member engageable with the corresponding first bar when the divider member is fastened thereto to prevent movement of the divider member laterally toward the side portions 202 and 204 of the body member 201. In the exemplary embodiment of FIGS. 4*a* and 4*c*, the first divider member 230 includes a first tab 233 disposed on the first cover portion 232 engageable with the first bar 250. More particularly, in FIG. 4*c*, the first tab 233 is disposed in a recess 252 on an upper portion of the first bar 250 and is engageable with a protrusion 253 thereon to prevent movement of the first divider member in a first direction toward the second side portion 204 of the buckle. Alternatively, the first tab 233 may be disposed into a recess on the first bar 250 to prevent movement of the divider member 230 toward either side portion 202 and 204 of the body member.

FIGS. 4*a* and 4*b* illustrate the first divider member 230 having a second arm portion 237 extending from the first cover portion 232 on a second side of the first bar 250 opposing the side thereof on which the first arm portion 234 extends. The second arm portion 237 is also a resilient member and preferably includes a second flange portion 239 engageable with the first bar 250, and more particularly a lower portion 256 thereof to further fasten the divider member 230 to the body member 201. The second arm portion 237 and the second flange portion 239 are also resilient so that when the second arm portion 237 is disposed along the first bar 250, the second arm portion 237 is flexible away from the first bar 250 to permit passage of the second flange portion 239 about the lower portion 256 of the first bar 250, whereupon the second arm portion 237 is flexible back toward the first bar so that the second flange portion 239 engages the first bar 250.

FIG. 4*b* illustrates the second arm portion 237 having a second tab 235 engageable with the first bar 250 to prevent movement of the first divider member in a second direction. More particularly, the second tab 235 is disposed in a recess 258 on the lower portion of the first bar 250 and is engageable with a protrusion 259 thereon to prevent movement of the first divider member in a second direction toward the first side portion 202 of the buckle. The first and second tabs 233 and 235 thus cooperate to prevent lateral movement of the divider member on the buckle.

The discrete divider members are preferably members formed unitarily from a plastic or other material in a molding operation. According to the present invention, the discrete divider members may be snap-fit into corresponding strap openings of a buckle or other strap accommodating device, and preferably one configured with a LADDERLOC to provide an adjustable coupling therebetween, to separate and prevent overlapping of separate side by side strap portions disposed through the substantially discrete openings formed by the discrete divider member.

Figure 5:
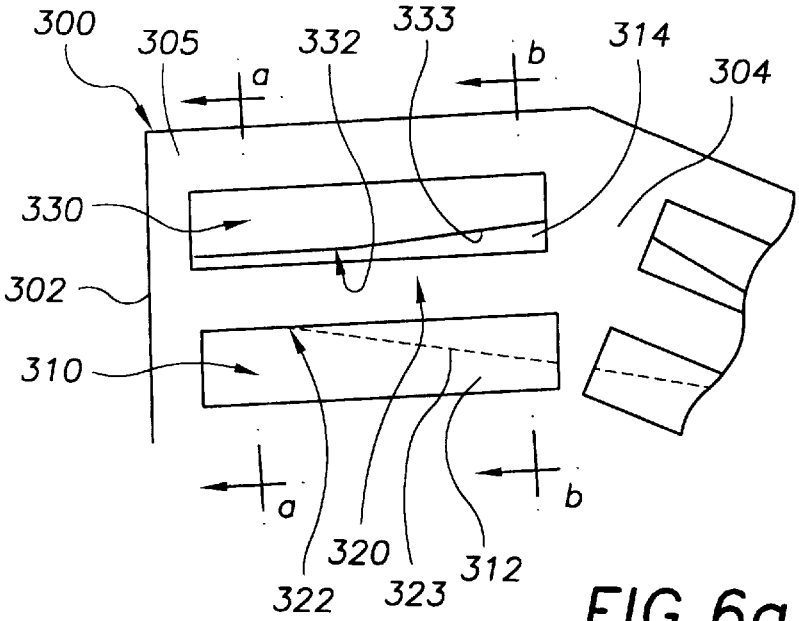
FIG. 5 is a partial plan view of a buckle portion according to another embodiment of the invention.

FIG. 5 illustrates an alternative buckle configuration particularly suitable for buckles of the type employed to fasten two strap portions extending from each side portion of a pack, as illustrated in FIG. 1. The alternative buckle configuration of FIG. 5 permits independent loosening of strap tension in any one of the strap portions without effecting or loosening the tension in the other strap portions, as discussed further below.

FIG. 5 illustrates a portion of a buckle body member 300 having a first opening 310 on a first portion thereof. The opening 310 is preferably a first slot disposed through the body member and extends generally between first and second side portions thereof as discussed above in connection with the openings of the buckles of FIGS. 1 and 2, and preferably the buckle 120 of FIG. 1. A first bar 320 is disposed in the first opening 310 to form two first opening portions 312 and 314, which are arranged generally parallel. The first opening 310 also includes a second bar 330 to provide a LADDERLOC strap adjustment coupling on the buckle, as discussed generally above.

Figure 6A:
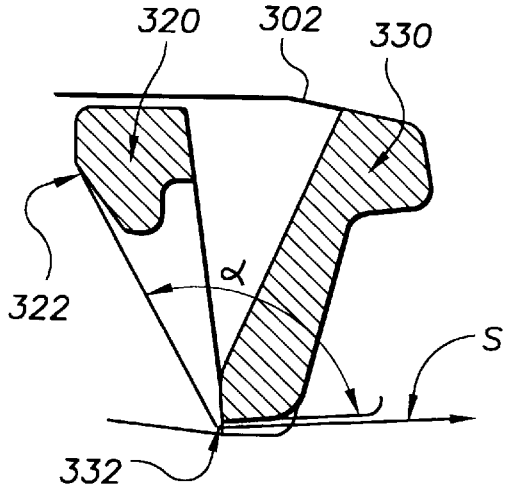
FIG. 6*a* is a partial sectional view along lines a—a of FIG. 5.
Figure 6B:
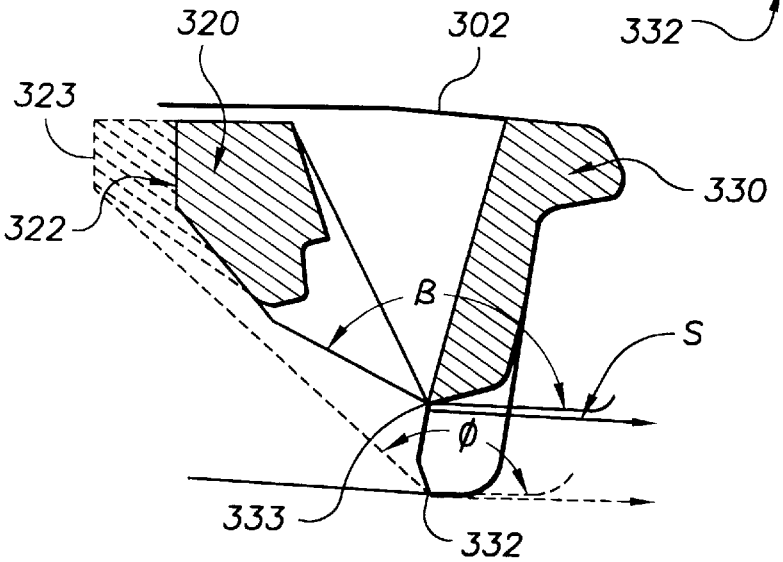
FIG. 6*b* is a partial sectional view along lines b—b of FIG. 5.

FIGS. 6*a* and 6*b* illustrate a strap portion S disposed about the first bar 320 so that overlapping strap portions thereof are frictionally engageable adjacent the second bar 330. More particularly, the first bar 320 includes a first strap engagement portion 322 extending generally between first and second side portions of the body member 300, as illustrated in FIGS. 5, 6*a* and 6*b*. The second bar 330 also includes a second strap engagement portion 332 extending generally between the first and second side portions of the body member 300, illustrated generally in FIGS. 5, 6*a* and 6*b*. The first strap engagement portion 322 is on a portion of the first bar 320 directed generally away from the second bar 330.

At least a portion of one or both of the first and second strap engagement portions 322 and 332 are arranged at an angle to form a first strap twisting path on the body member. FIGS. 5 and 6*b* illustrate at least a portion 333 of the second strap engaging portion 332 disposed at an angle, or generally non-parallel, relative to the first strap engaging portion 322. FIGS. 5 and 6*b* also illustrate alternatively, in phantom lines, at least a portion 323 of the first strap engaging portion 322 disposed at an angle, or generally non-parallel, to the second strap engaging portion 332. Alternatively, the strap twisting path of the buckle is formed by both angled portions 323 and 333 in combination.

The strap is coupled to the body member by extending generally from the second strap engagement portion 332, about the first bar 320 and the first strap engagement portion 322 thereof, and back toward the second strap engagement portion 332. The strap twisting path is generally between the first strap engagement portion 322 and the second strap engagement portion 332, whereby the strap extending therebetween is twisted. According to the invention, a first angle of the strap twisting path toward the first side portion of the body member is different than a second angle of the strap twisting path toward the second side portion of the body member.

FIGS. 6*a* and 6*b* illustrate the twisted strap portion disposed along the strap twisting path between the first and second strap engagement portions 322 and 332. The strap twisting path, and more particularly the twisted strap portion therealong is characterized generally by a variation in an angle between the strap portion disposed between the first and second strap engaging portions 322 and 332 measured relative to a strap portion extending away from the buckle. FIG. 6*a* illustrates an outer side strap portion toward a side portion 302 of the buckle having an angle $\alpha$, and FIG. 6*b* illustrates an inner side strap portion toward an interior portion 304 of the buckle having an angle $\beta$ greater than the angle $\alpha$ by virtue of the portion 333 of the second strap engaging portion 332 configured at an angle or non-parallel to the first strap engaging portion 322. FIG. 6*b* also illustrates alternatively and in phantom lines the inner side strap portion toward the interior portion 304 of the buckle having an angle $\phi$ greater than the angle $\alpha$ by virtue of the portion 323 of the first strap engaging portion 322 configured at an angle or non-parallel to the second strap engaging portion 332. Thus the angle between the first and second strap engagement portions twists the strap portion disposed along the strap twisting path between the first strap engagement portion 322 and the second strap engagement portion 333.

Generally, to release a tensioned strap portion adjustably coupled to a prior art LADDEROC, the angle between the strap portion between the first and second bars and the tensioned strap portion extending away from an end portion of the buckle is increased by pivoting or lifting the end portion thereof. However, in pack mounting applications where two strap portions are coupled to a common end portion of the buckle, as illustrated in FIG. 1, lifting the end portion of the buckle simultaneously releases both strap portions adjustably coupled thereto, which is not always desirable. In other words, in some applications it is desirable to loosen, or release, only one of the two strap portions on the same end of the buckle.

According to the invention, adjacent first and second LADDERLOCS are disposed on both end portions of the buckle for accommodating adjacent strap portions on each end portion thereof, as illustrated generally in FIG. 1. The adjacent LADDERLOCS on at least one and preferably on both end portions of the buckle include a corresponding strap twisting path, as discussed above generally in connection with FIGS. 5, 6*a* and 6*b*. The strap twisting paths of the adjacent LADDERLOCS are oriented so that an angle of an outer portion of each strap twisting path toward a corresponding side portion of the buckle is less than the angle of an inner portion of the corresponding strap twisting path toward an interior portion of the buckle. In other words, the strap twisting paths of adjacent LADDERLOCS are mirror images of each other, as illustrated in FIG. 5.

Twisting a strap portion between the first and second strap engagement portions 322 and 332 increases the frictional binding of the strap portion coupled to the buckle. To adjustably release, or loosen, the twisted strap portion, an end portion of the buckle near the side portion thereof, and more particularly a corner portion 305 of the buckle, is raised slightly to decrease the frictional binding of the strap portion coupled to the buckle so that the strap may be loosened. Since only the corner portion 305 of the buckle is raised, the adjacent strap portion coupled to the same end portion of the buckle is not loosened, and the strap portions coupled to the other opposing end portion of the buckle are not loosened. In application, when the buckle is disposed on the torso front side portion 54, the corner 305 of the buckle corner portion nearest the strap portion to be released is lifted away from the torso, thereby loosening the strap portion. For example, lifting an upper corner of the buckle releases the corresponding upper strap portion, and lifting a lower corner of the buckle releases the corresponding lower strap portion.

Preferably each of the two LADDERLOCS on the corresponding opposing end portions of the buckle in FIG. 1 include corresponding strap twisting paths between the corresponding first and second bars thereof. Thus any one of the strap portions 10–40 may be loosened independently without loosening the other strap portions and without opening or releasing the buckle, which is highly desirable and a substantial improvement over prior art buckles.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An apparatus useable for holding a pack on a back side portion of a person having a waist portion with first and second upper pelvis portions on generally opposing sides thereof, the apparatus comprising:

a buckle having generally opposing first and second side portions and generally opposing first and second end portions;

a first adjustable strap portion coupled to and extending from the first end portion of the buckle, the first strap portion extending from a first side portion of the pack;

a second adjustable strap portion coupled to and extending from the first end portion of the buckle, the second strap portion extending from the first side portion of the pack separate from the first strap portion;

a third adjustable strap portion coupled to and extending from the second end portion of the buckle, the third strap portion extending from a second side portion of the pack;

a fourth adjustable strap portion coupled to and extending from the second end portion of the buckle, the fourth strap portion extending from the second side portion of the pack separate from the third strap portion, the first and second strap portions are disposed about a first side of the waist portion and are coupled to the first end portion of the buckle forwardly of the first upper pelvis portion and the third and fourth strap portions are disposed about a second side of the waist portion and are coupled to the second end portion of the buckle forwardly of the second upper pelvis portion when the buckle is located on a front side portion of the person and the pack is mounted on a back side portion of the person.

2. The apparatus of claim 1, the buckle comprising first and second releasably engageable buckle members, the first and second strap portions are adjustably coupled to the first buckle member, the third and fourth strap portions are adjustably coupled to the second buckle member.

3. The apparatus of claim 1, the buckle comprising a first substantially discrete opening through a first portion of the buckle into which the first strap portion is disposed, a second substantially discrete opening through a second portion of the buckle into which the second strap portion is disposed, the first and second substantially discrete openings arranged generally end to end between the first and second side portions of the buckle, the first and second substantially discrete openings arranged at an angle so that the first and second strap portions extend divergently from the buckle, a third substantially discrete opening through a third portion of the buckle into which the third strap portion is disposed, a fourth substantially discrete opening through a fourth portion of the buckle into which the fourth strap portion is disposed, the third and fourth substantially discrete openings arranged generally end to end between the first and second side portions of the buckle, the third and fourth substantially discrete openings arranged at an angle so that the third and fourth strap portions extend divergently from the buckle.

4. The apparatus of claim 3, the buckle comprising first and second releasably engageable buckle members, the first buckle member has a recess portion, and the second buckle member has a tongue portion engageably and releasably disposable in the recess portion of the first buckle member, the first and second substantially discrete openings are slots located on a first portion of the first buckle member generally opposing the recess portion, and the third and fourth substantially discrete openings are slots located on a second portion of the second buckle member generally opposing the tongue portion.

5. The apparatus of claim 1, a first substantially discrete opening through a first portion of the buckle into which the first strap portion is disposed, the first substantially discrete opening includes a first bar and a second bar, the first strap portion disposed about the corresponding first bar so that overlapping portions of the first strap portion are frictionally engageable adjacent the corresponding second bar, a second substantially discrete opening through a second portion of the buckle into which the second strap portion is disposed, the second substantially discrete opening includes a first bar and a second bar, the second strap portion disposed about the corresponding first bar so that overlapping portions of the second strap portion are frictionally engageable adjacent the corresponding second bar, a third substantially discrete opening through a third portion of the buckle into which the third strap portion is disposed, the third substantially discrete opening includes a first bar and a second bar, the third strap portion disposed about the corresponding first bar so that overlapping portions of the third strap portion are frictionally engageable adjacent the corresponding second bar, and a fourth substantially discrete opening through a fourth portion of the buckle into which the fourth strap portion is disposed, the fourth substantially discrete opening includes a first bar and a second bar, the fourth strap portion disposed about the corresponding first bar so that overlapping portions of the fourth strap portion are frictionally engageable adjacent the corresponding second bar.

6. The apparatus of claim 1 further comprising, in combination therewith, a pack, the first and second strap portions coupled to and extending from a first side portion of the pack, and the third and fourth strap portions coupled to and extending from a second side portion of the pack.

7. The apparatus of claim 1, a first substantially discrete opening through a first portion of the buckle into which the first strap portion is disposed, the first substantially discrete opening includes a first bar and a second bar, the first bar of the first opening having a first strap engagement portion, and the second bar of the first opening having a second strap engagement portion, the first strap portion disposed about the first bar of the first opening, at least a portion of one of the first and second strap engagement portions of the first opening at an angle to twist the first strap portion between the first strap engagement portion and the second strap engagement portion of the first opening, and a second substantially discrete opening through a second portion of the buckle into which the second strap portion is disposed, the second substantially discrete opening includes a first bar and a second bar, the first bar of the second opening having a first strap engagement portion, and the second bar of the second opening having a second strap engagement portion, the second strap portion disposed about the first bar of the second opening, at least a portion of one of the first and second strap engagement portions of the second opening at an angle to twist the second strap portion between the first strap engagement portion and the second strap engagement portion of the second opening.

8. The apparatus of claim 7, an outer portion of the first strap portion toward the first side portion of the buckle twisted more than an inner portion of the first strap portion toward an interior portion of the buckle, and an outer portion of the second strap portion toward the second side portion of the buckle twisted more than an inner portion of the second strap portion toward an interior portion of the buckle.

9. A buckle comprising:

a body member having first and second generally opposing side portions and first and second generally opposing end portions, a first opening on the first end portion of the body member, the first opening extending between the first and second side portions of the body member, and a second opening on the second end portion of the body member, the second opening extending between the first and second side portions of the body member, a discrete first divider member disposed and retained at least partially in the first opening of the body member to at least partially divide the first opening into two opening portions arranged generally end to end between the first and second side portions of the body member, whereby the two opening portions of the body member accommodate corresponding first and second separate strap portions arranged generally side by side between the first and second side portions of the body member so that the first and second separate strap portions are separated by the first divider member.

10. The buckle of claim 9, the body member has a first buckle member having a recess portion, and the body member has a second buckle member having a tongue portion engageably and releasably disposable in the recess portion of the first buckle member, the first opening is a first slot through the first buckle member on a first portion of the first buckle member generally opposing the recess portion, and the second opening is a second slot through the second buckle member on a second portion of the second buckle member generally opposing the tongue portion.

11. The buckle of claim 9 further comprising a discrete second divider member disposed and retained at least partially in the second opening of the second buckle member to at least partially divide the second opening into two opening portions arranged generally end to end between the first and second side portions of the body member.

12. The buckle of claim 9, the first opening of the body member is a first slot through the body member extending between the first and second side portions of the body member, a first bar disposed in the first slot to form first generally parallel slot portions between the first and second side portions of the body member, the first divider member is disposed over the first bar and fastened to the body member.

13. The buckle of claim 12, the first slot is defined partially by a second bar generally parallel to the first bar, the first divider member having a first cover portion disposed over the first bar, the first divider member having a resilient first arm portion extending between the first bar and the second bar, the first arm portion having a first flange portion engageable with the second bar to fasten the first divider member to the body member.

14. The buckle of claim 13, the first divider member includes a first spring member extending from the first arm portion, the first spring member is flexed when the first divider member is fastened to the body member.

15. The buckle of claim 13, the first divider member having a resilient second arm portion extending from the first cover portion on a side of the first bar, the second arm portion having a second flange portion engageable with the first bar to fasten the first divider member to the body member.

16. The buckle of claim 15, the first divider member having a first tab disposed on the first cover portion engageable with the first bar to prevent movement of the first divider member in a first direction, and a second tab on the second arm portion engageable with the first bar to prevent movement of the first divider member in a second direction.

17. The buckle of claim 9, the first divider member having a member engageable with the first bar to prevent movement of the first divider member.

18. A buckle comprising:

a body member having first and second side portions;

a first opening on a first portion of the body member, the first opening extending between the first and second side portions of the body member;

a first bar disposed in the first opening to form two first opening portions extending between the first and second side portions of the body member, the first bar of the first opening having a first strap engagement portion extending between the first and second side portions of the body member;

a second bar partially defining the first opening, the second bar of the first opening having a second strap engagement portion extending between the first and second side portions of the body member, at least a portion of one of the first and second strap engagement portions of the first opening arranged at an angle to form a first strap twisting path between the first strap engagement portion and the second strap engagement portion.

19. The buckle of claim 18, the strap twisting path extending between the first strap engagement portion and the second strap engagement portion of the first opening, a first angle of the strap twisting path toward the first side portion of the body member is different than a second angle of the first strap twisting path toward the second side portion of the body member.

20. The buckle of claim 18, at least a portion of the second strap engagement portion is non-parallel to the first strap engagement portion to form the first strap twisting path between the first strap engagement portion and the second strap engagement portion.

21. The buckle of claim 18 further comprising:

a second opening on the first portion of the body member, the first and second openings are substantially discrete and are arranged generally end to end between the first and second side portions of the body member, a first bar disposed in the second opening to form two second opening portions extending between the first and second side portions of the body member, the first bar of the second opening having a first strap engagement portion extending between the first and second side portions of the body member, a second bar partially defining the second opening, the second bar of the second opening having a second strap engagement portion extending between the first and second side portions of the body member, at least a portion of one of the first and second strap engagement portions of the second opening arranged at an angle to form a second strap twisting path between the first strap engagement portion and the second strap engagement portion.

22. A buckle comprising:

a body member having generally opposing first and second end portions, and generally opposing first and second side portions;

first and second substantially discrete slots through the first end portion of the body member, the first and second substantially discrete slots arranged generally end to end between the first and second side portions of the body member, the first and second substantially discrete slots oriented at an angle relative to each other on the first end portion of the body member;

third and fourth substantially discrete slots through the second end portion of the body member, the third and fourth substantially discrete slots arranged generally end to end between the first and second side portions of the body member, the third and fourth substantially discrete slots oriented at an angle relative to each other on the second end portion of the body member, the first and second substantially discrete slots on the first end portion of the body member are symmetric with the third and fourth substantially discrete slots on the second end portion of the body member, the first and third substantially discrete slots on the first side portion of the body member are symmetric with the second and fourth substantially discrete slots on the second side portion of the body member.

23. The buckle of claim 22, the body member comprising first and second buckle members, the first buckle member has a recess portion, and the second buckle member has a tongue portion engageably and releasably disposable in the recess portion of the first buckle member.

24. The buckle of claim 22, the first and second substantially discrete slots are disposed on the first end portion of the body member at an angle so that corresponding first and second straps coupled thereto extend divergently from the first end portion of the body member with an angle therebetween less than 90 degrees, and the third and fourth substantially discrete slots are disposed on the second end portion of the body member at an angle so that corresponding third and fourth straps coupled thereto extend divergently from the second end portion of the body member with an angle therebetween less than 90 degrees.

25. The buckle of claim 22, the first substantially discrete slot includes a first bar and a second bar, the first bar of the first substantially discrete slot having a first strap engagement portion, the second bar of the first substantially discrete slot having a second strap engagement portion, at least a portion of one of the first and second strap engagement portions of the first substantially discrete slot at an angle to form a first strap twisting path between the first strap engagement portion and the second strap engagement portion; and the second substantially discrete slot includes a first bar and a second bar, the first bar of the second substantially discrete slot having a first strap engagement portion, the second bar of the second substantially discrete slot having a second strap engagement portion, at least a portion of one of the first and second strap engagement portions of the second substantially discrete slot at an angle to form a second strap twisting path between the first strap engagement portion and the second strap engagement portion.

* * * * *